US010174938B2

(12) United States Patent
Krichtafovitch

(10) Patent No.: US 10,174,938 B2
(45) Date of Patent: Jan. 8, 2019

(54) LOW INERTIA POWER SUPPLY FOR APPLYING VOLTAGE TO AN ELECTRODE COUPLED TO A FLAME

(71) Applicant: CLEARSIGN COMBUSTION CORPORATION, Seattle, WA (US)

(72) Inventor: Igor A. Krichtafovitch, Kirkland, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 93 days.

(21) Appl. No.: 15/318,965

(22) PCT Filed: Jun. 29, 2015

(86) PCT No.: PCT/US2015/038277
§ 371 (c)(1),
(2) Date: Dec. 14, 2016

(87) PCT Pub. No.: WO2016/003883
PCT Pub. Date: Jan. 7, 2016

(65) Prior Publication Data

US 2017/0146233 A1 May 25, 2017

Related U.S. Application Data

(60) Provisional application No. 62/019,392, filed on Jun. 30, 2014.

(51) Int. Cl.
*F23C 99/00* (2006.01)
*F23N 5/12* (2006.01)

(52) U.S. Cl.
CPC ..... *F23C 99/001* (2013.01); *F23N 5/123* (2013.01); *F23N 2029/12* (2013.01)

(58) Field of Classification Search
CPC ..... F23C 99/001
USPC ..... 431/258
See application file for complete search history.

(56) References Cited

U.S. PATENT DOCUMENTS

| | | | | |
|---|---|---|---|---|
| 2,604,936 A | | 7/1952 | Kaehni et al. | |
| 2,898,981 A | * | 8/1959 | Westbrook | F23N 5/085 431/25 |
| 3,306,338 A | | 2/1967 | Wright et al. | |
| 3,425,780 A | * | 2/1969 | Potts | F23N 5/082 431/68 |
| 3,520,645 A | * | 7/1970 | Cotton | F23N 5/123 431/71 |
| 4,111,636 A | | 9/1978 | Goldberg | |
| 4,710,125 A | | 12/1987 | Nakamura et al. | |
| 4,904,986 A | * | 2/1990 | Pinckaers | F23N 5/082 250/554 |

(Continued)

FOREIGN PATENT DOCUMENTS

| | | |
|---|---|---|
| EP | 0844434 | 5/1998 |
| JP | H 07-48136 | 2/1995 |

(Continued)

OTHER PUBLICATIONS

PCT International Search Report and Written Opinion of PCT Application No. PCT/US2015/038277 dated Sep. 24, 2015.

*Primary Examiner* — Avinash Savani
(74) *Attorney, Agent, or Firm* — Christopher A. Wiklof; Nicholas S. Bromer; Launchpad IP, Inc.

(57) ABSTRACT

A system and method for electrically charging a combustion flame with a power supply.

40 Claims, 6 Drawing Sheets

(56) References Cited

U.S. PATENT DOCUMENTS

| | | | |
|---|---|---|---|
| 5,577,905 | A | 11/1996 | Momber et al. |
| 5,784,889 | A | 7/1998 | Joos et al. |
| 7,137,808 | B2 | 11/2006 | Branston et al. |
| 7,243,496 | B2 | 7/2007 | Pavlik et al. |
| 7,944,678 | B2 | 5/2011 | Kaplan et al. |
| 8,851,882 | B2 | 10/2014 | Hartwick et al. |
| 8,881,535 | B2 | 11/2014 | Hartwick et al. |
| 8,911,699 | B2 | 12/2014 | Colannino et al. |
| 9,151,549 | B2 | 10/2015 | Goodson et al. |
| 9,209,654 | B2 | 12/2015 | Colannino et al. |
| 9,243,800 | B2 | 1/2016 | Goodson et al. |
| 9,267,680 | B2 | 2/2016 | Goodson et al. |
| 9,284,886 | B2 | 3/2016 | Breidenthal et al. |
| 9,289,780 | B2 | 3/2016 | Goodson |
| 9,310,077 | B2 | 4/2016 | Breidenthal et al. |
| 9,366,427 | B2 | 6/2016 | Sonnichsen et al. |
| 9,371,994 | B2 | 6/2016 | Goodson et al. |
| 9,377,188 | B2 | 6/2016 | Ruiz et al. |
| 9,377,189 | B2 | 6/2016 | Ruiz et al. |
| 9,377,195 | B2 | 6/2016 | Goodson et al. |
| 9,441,834 | B2 | 9/2016 | Colannino et al. |
| 9,469,819 | B2 | 10/2016 | Wiklof |
| 9,494,317 | B2 | 11/2016 | Krichtafovitch et al. |
| 9,496,688 | B2 | 11/2016 | Krichtafovitch et al. |
| 2005/0208442 | A1 | 9/2005 | Heiligers et al. |
| 2013/0071794 | A1 | 3/2013 | Colannino et al. |
| 2013/0230810 | A1 | 9/2013 | Goodson et al. |
| 2013/0260321 | A1 | 10/2013 | Colannino et al. |
| 2013/0323655 | A1 | 12/2013 | Krichtafovitch et al. |
| 2013/0323661 | A1 | 12/2013 | Goodson et al. |
| 2013/0333279 | A1 | 12/2013 | Osler et al. |
| 2013/0336352 | A1 | 12/2013 | Colannino et al. |
| 2014/0051030 | A1 | 2/2014 | Colannino et al. |
| 2014/0065558 | A1 | 3/2014 | Colannino et al. |
| 2014/0076212 | A1 | 3/2014 | Goodson et al. |
| 2014/0080070 | A1 | 3/2014 | Krichtafovitch et al. |
| 2014/0162195 | A1 | 6/2014 | Lee et al. |
| 2014/0162197 | A1 | 6/2014 | Krichtafovitch et al. |
| 2014/0162198 | A1 | 6/2014 | Krichtafovitch et al. |
| 2014/0170569 | A1 | 6/2014 | Anderson et al. |
| 2014/0170571 | A1 | 6/2014 | Casasanta, III et al. |
| 2014/0170575 | A1 | 6/2014 | Krichtafovitch |
| 2014/0170576 | A1 | 6/2014 | Colannino et al. |
| 2014/0170577 | A1 | 6/2014 | Colannino et al. |
| 2014/0196368 | A1 | 7/2014 | Wiklof |
| 2014/0208758 | A1 | 7/2014 | Breidenthal et al. |
| 2014/0212820 | A1 | 7/2014 | Colannino et al. |
| 2014/0216401 | A1 | 8/2014 | Colannino et al. |
| 2014/0227645 | A1 | 8/2014 | Krichtafovitch et al. |
| 2014/0227646 | A1 | 8/2014 | Krichtafovitch et al. |
| 2014/0227649 | A1 | 8/2014 | Krichtafovitch et al. |
| 2014/0248566 | A1 | 9/2014 | Krichtafovitch et al. |
| 2014/0255855 | A1 | 9/2014 | Krichtafovitch |
| 2014/0255856 | A1 | 9/2014 | Colannino et al. |
| 2014/0272731 | A1 | 9/2014 | Breidenthal et al. |
| 2014/0287368 | A1 | 9/2014 | Krichtafovitch et al. |
| 2014/0295094 | A1 | 10/2014 | Casasanta, III |
| 2014/0295360 | A1 | 10/2014 | Wiklof |
| 2014/0335460 | A1 | 11/2014 | Wiklof et al. |
| 2015/0079524 | A1 | 3/2015 | Colannino et al. |
| 2015/0104748 | A1 | 4/2015 | Dumas et al. |
| 2015/0107260 | A1 | 4/2015 | Colannino et al. |
| 2015/0118629 | A1 | 4/2015 | Colannino et al. |
| 2015/0121890 | A1 | 5/2015 | Colannino et al. |
| 2015/0140498 | A1 | 5/2015 | Colannino |
| 2015/0147704 | A1 | 5/2015 | Krichtafovitch et al. |
| 2015/0147705 | A1 | 5/2015 | Colannino et al. |
| 2015/0147706 | A1 | 5/2015 | Krichtafovitch et al. |
| 2015/0219333 | A1 | 8/2015 | Colannino et al. |
| 2015/0226424 | A1 | 8/2015 | Breidenthal et al. |
| 2015/0276211 | A1 | 10/2015 | Colannino et al. |
| 2015/0338089 | A1 | 11/2015 | Krichtafovitch et al. |
| 2015/0345780 | A1 | 12/2015 | Krichtafovitch |
| 2015/0345781 | A1 | 12/2015 | Krichtafovitch et al. |
| 2015/0362177 | A1 | 12/2015 | Krichtafovitch et al. |
| 2015/0362178 | A1 | 12/2015 | Karkow et al. |
| 2015/0369476 | A1 | 12/2015 | Wiklof |
| 2016/0018103 | A1 | 1/2016 | Karkow et al. |
| 2016/0033125 | A1 | 2/2016 | Krichtafovitch et al. |
| 2016/0040872 | A1 | 2/2016 | Colannino et al. |
| 2016/0091200 | A1 | 3/2016 | Colannino et al. |
| 2016/0138800 | A1 | 5/2016 | Anderson et al. |
| 2016/0161115 | A1 | 6/2016 | Krichtafovitch et al. |
| 2016/0215974 | A1 | 7/2016 | Wiklof |
| 2016/0273763 | A1 | 9/2016 | Colannino et al. |
| 2016/0273764 | A1 | 9/2016 | Colannino et al. |
| 2016/0290633 | A1 | 10/2016 | Cherpeske et al. |
| 2016/0290639 | A1 | 10/2016 | Karkow et al. |
| 2016/0298836 | A1 | 10/2016 | Colannino et al. |

FOREIGN PATENT DOCUMENTS

| | | |
|---|---|---|
| JP | 09-159166 | 6/1997 |
| WO | WO 2015/017084 | 2/2015 |
| WO | WO 2015/089306 | 6/2015 |
| WO | WO 2015/103436 | 7/2015 |
| WO | WO 2015/123683 | 8/2015 |

* cited by examiner

LOW INERTIA POWER SUPPLY FOR APPLYING VOLTAGE TO AN ELECTRODE COUPLED TO A FLAME

CROSS REFERENCE TO RELATED APPLICATIONS

The present application is a U.S. National Phase application under 35 U.S.C. § 371 of co-pending International Patent Application No. PCT/US2015/038277 entitled "LOW INERTIA POWER SUPPLY FOR APPLYING VOLTAGE TO AN ELECTRODE COUPLED TO A FLAME," filed Jun. 29, 2015, co-pending herewith; which claims priority benefit from U.S. Provisional Patent Application No. 62/019,392, entitled "LOW INERTIA POWER SUPPLY FOR APPLYING VOLTAGE TO AN ELECTRODE COUPLED TO A FLAME," filed Jun. 30, 2014; each of which, to the extent not inconsistent with the disclosure herein, is incorporated by reference.

SUMMARY

According to an embodiment, a system for electrically controlling a combustion flame includes a burner that is configured to generate the combustion flame. The combustion flame includes a resistance and a first capacitance. The system includes at least one electrode positioned proximate to the burner to couple the at least one electrode to the combustion flame. The system includes a power supply that is coupled to the at least one electrode and that is configured to provide a voltage signal to the combustion flame and charge the first capacitance. The power supply can include a second capacitance that is an output capacitance for the power supply. According to embodiments, the second capacitance is less than the first capacitance.

According to an embodiment, a method for electrically controlling a combustion flame includes generating a voltage signal with a power supply having an output capacitance. The voltage signal may include a positive polarity and may exclude a negative polarity. The method includes selectively charging the combustion flame with the voltage signal by coupling the power supply to the combustion flame with an electrode to alter one or more characteristics of the combustion flame. The combustion flame may be generated with a burner. The combustion flame includes a resistance and a load capacitance. The electrode may be positioned proximate to and/or within the combustion flame. According to embodiments, the output capacitance is less than or equal to the load capacitance to enable rapid discharge of the power supply.

According to one embodiment, a computer-implemented system for electrically controlling a combustion flame includes a non-transitory computer-readable medium having instructions. The system also includes a processor configured to read the computer-readable medium and to execute the instructions to perform a method for electrically controlling a combustion flame. The method may include generating a voltage signal with a power supply having an output capacitance. The voltage signal can include a first polarity and can exclude a second polarity. While the first and second polarities can be selected arbitrarily, for economy of language the first polarity may be referred to as positive herein. The method includes selectively charging the combustion flame with the voltage signal by coupling the power supply to the combustion flame with an electrode to alter one or more characteristics of the combustion flame. The combustion flame may be generated with a burner. The combustion flame can be characterized by a resistance and a load capacitance. The electrode may be positioned proximate to and/or within the combustion flame. In an embodiment, the output capacitance is less than or equal to the load capacitance to enable rapid discharge of the power supply.

DETAILED DESCRIPTION

Figure 1:
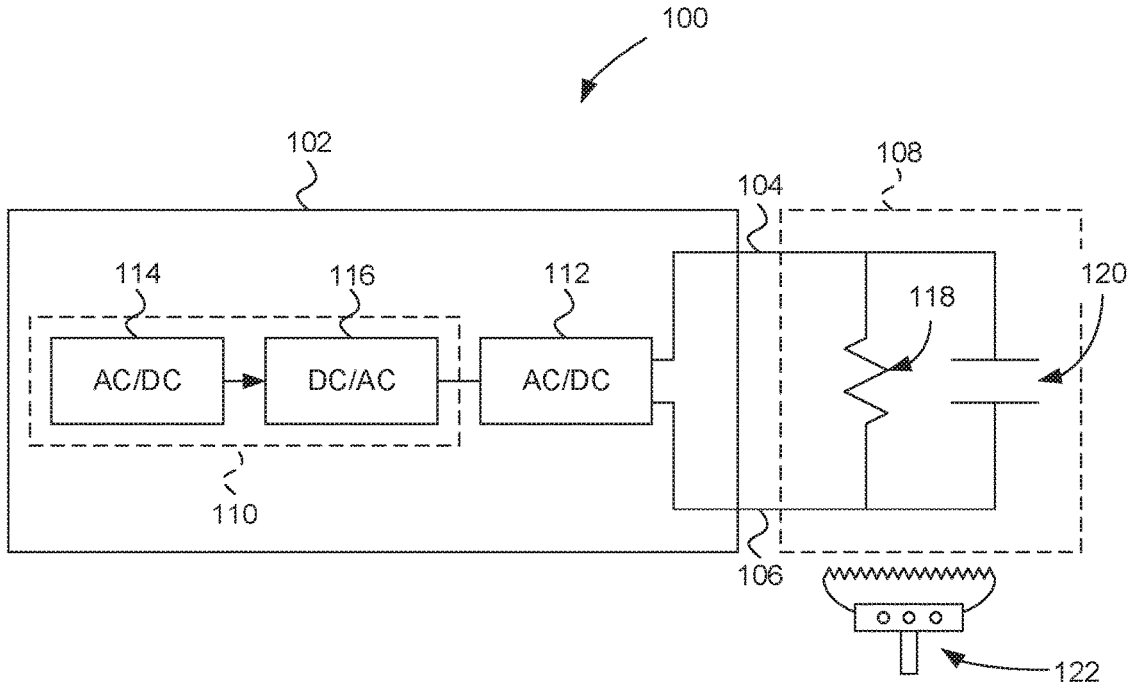
FIG. 1 is a block diagram of a power supply for applying voltage to a combustion flame, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

Electrodynamic combustion control may be used to control and/or vary characteristics of a combustion flame. The application of a voltage, charge, current, and/or electric field to a combustion flame may be used to improve heat distribution of the flame, to stabilize the flame, and/or to prevent flame impingement. The application of electrodynamic combustion control may also improve the energy efficiency, shape, and/or heat transfer of the flame.

A power supply may apply direct current ("DC") voltage to an electrode for the electrodynamic control of a flame in a combustion volume. To reduce any ripple on the DC voltage, the power supply can employ low pass filtering with, for example, an output capacitor. If the power supply uses a very large filter capacitor, i.e., has a large output capacitance, the power supply can provide a DC voltage to the combustion flame that has a relatively small ripple. However, when the power or electrical energy that is supplied to the flame is switched off, the energy stored in the filter capacitor (or output capacitance) of the power supply can present at least two undesirable effects. First, the stored energy can provide safety concerns. If for example, a person were to touch an electrode coupled to the output of the power supply, the power supply can transfer the stored energy into the person at the risk of the person's safety or health. Second, the stored energy can reduce the speed by which a DC voltage of a second, e.g., negative, polarity may be applied to the flame because output capacitance can maintain the DC voltage until the output capacitance is discharged, e.g., via the parasitic resistances of the power supply or through the resistance of the flame. For example, in some implementations, to electrodynamically control the combustion flame, one or more power supplies may be configured to alternate between selectively applying a positive polarity and a negative polarity voltage to the combustion flame.

According to various embodiments of the disclosure, a power supply can charge a combustion flame, e.g., a load capacitance, by using a small output capacitance, e.g., no output capacitor, to enable rapid ("inertialess") charging/discharging of the power supply output and the combustion flame.

FIG. 1 illustrates an electrodynamic flame control system 100 for applying a DC voltage to a combustion flame, according to one embodiment. As used herein "electrodynamic flame control" may refer to the application of a voltage, charge, current, and/or electric field to control combustion flame behavior and to improve heat distribution in a combustion volume. The electrodynamic flame control system 100 includes a power supply 102 and electrodes 104 and 106 for applying a DC voltage to a combustion flame 108, according to one embodiment.

The power supply 102 may be configured to rapidly charge the combustion flame 108 with a high-power DC voltage, according to one embodiment. The power supply 102 may be configured as an inertialess power supply to enable the power supply 102 to rapidly charge the combustion flame 108. As used herein "inertialess power supply" may refer to a power supply with little or no electric charge, magnetic flux, or other energy sources stored in the power supply 102, so the power supply output may rapidly provide and remove an electric potential across one or more electrodes 104, 106 or power supply output terminals. The power supply 102 may be configured to provide an output voltage that is greater than 4 kV. In one embodiment, the power supply 102 can provide an output voltage in the range of 30-50 kV. In one specific embodiment, the power supply 102 is configured to provide an output voltage that is approximately 40 kV. According to various embodiments, the power supply 102 provides an output voltage or output voltage signal with a value that is between 30-50 kV.

The power supply 102 can be configured to provide an output voltage based on a range of input voltages, according to one embodiment. The power supply 102 can include an AC power supply 110 and an AC/DC voltage converter 112. The AC power supply 110 can be configured to convert 60 Hz of voltage into another higher frequency voltage. In some embodiments, the AC power supply 110 converts a 60 Hz voltage signal into a voltage signal having a frequency that is between 10 kHz-400 kHz. In one particular embodiment, the AC power supply 110 converts a 60 Hz voltage signal into a voltage signal having a frequency that is approximately 100 kHz. To convert a lower frequency voltage signal into a higher frequency voltage signal, the AC power supply 110 may include a rectifier 114, e.g., an AC/DC voltage converter and an inverter 116, e.g., a DC/AC voltage converter. The rectifier 114 can be configured to convert, for example, a 120 VAC voltage signal into a 160 VDC rectified voltage signal. In one implementation, the rectifier 114 includes a transformer coupled to a half-wave or full-wave bridge rectifier. The inverter 116 receives a DC voltage signal from the rectifier 114 and can be configured to provide a higher frequency AC voltage signal to the AC/DC voltage converter 112. In one embodiment, the inverter 116 is a switch mode power supply. According to one embodiment, the inverter 116 converts the DC rectified voltage signal, e.g., 160 VDC, to a 100 kHz AC voltage. In one embodiment, the 100 kHz AC voltage is approximately 120 V as measured from zero to peak.

The AC/DC voltage converter 112 can receive an AC voltage signal from the AC power supply 110 to provide a DC voltage signal to the combustion flame 108, according to one embodiment. In one embodiment, the AC/DC voltage converter 112 may be configured to provide a voltage signal having a positive polarity and not a negative polarity, or vice versa. The AC/DC voltage converter 112 may be configured to provide an inertialess and high power output voltage. In other words, the AC/DC voltage converter 112 may be configured to provide a low-capacitance and high power output voltage. In one embodiment, the output capacitance of the AC/DC voltage converter 112 is less than or equal to an inherent capacitance, i.e., a load capacitance, of the combustion flame 108. For example, the AC/DC voltage converter 112 can include one or more transformers electrically coupled or connected to one or more rectifier circuits without employing capacitive or other low pass output filtering. In other words, the AC/DC voltage converter 112 may use capacitors having relatively small values and/or may exclude use of any capacitors after any rectifier circuits. Advantageously, the AC/DC voltage converter 112, without the use of output capacitors or other low pass output filtering, can quickly provide or generate a high power output voltage, e.g., a voltage that is greater than 4 kV or that is in the range of 30-50 kV, for charging the combustion flame 108. Another advantage of excluding the use of the output capacitors or other low pass filtering is that the power supply 102 can quickly remove the output voltage from one or more of the electrodes 104 and 106 to enable the combustion flame 108 to be charged with another voltage signal, e.g., a voltage signal having a different value or an opposite polarity.

The combustion flame 108 includes a resistance 118 and a capacitance 120, according to one embodiment. The resistance 118 can vary based on the temperature, length, width, and/or composition of the combustion flame 108. According to one embodiment, the resistance 118 is approximately 10 megaohms ("MΩ"). In other embodiments, the resistance 118 can be within 5-15 MΩ. The capacitance 120 can also vary based on various characteristics of the combustion flame 108. In one embodiment, the capacitance 120 can be within 3-5 picofarads ("pF"). As illustrated, the combustion flame 108 can be provided or generated by one or more burners 122, according to various embodiments.

By excluding or omitting an output capacitance or low-pass filtering from the power supply 102, the power supply 102 can be configured to rapidly charge the capacitance 120 of the combustion flame 108, according to one embodiment. Additionally, by having an output capacitance that is less than the load capacitance, e.g., 3-5 pF, the power supply 102 or another power supply can be coupled to the combustion flame 108 to charge the capacitance 120 to another voltage polarity, e.g., to a negative DC voltage, without having to first discharge the output capacitance or low pass output filtering of the power supply 102. For example, if the power supply 102 is configured to supply 100 mA, the power supply 102 could charge a 5 pF capacitance of the combustion flame 108 from 0 V to 40 kV in approximately 2 microseconds ("μs"). Assuming a similar discharge time for the capacitance 120, the power supply 102 can be configured to alternate between selectively charging and discharging the combustion flame 108 at a frequency of approximately 500 kHz, according to one embodiment.

Figure 2:
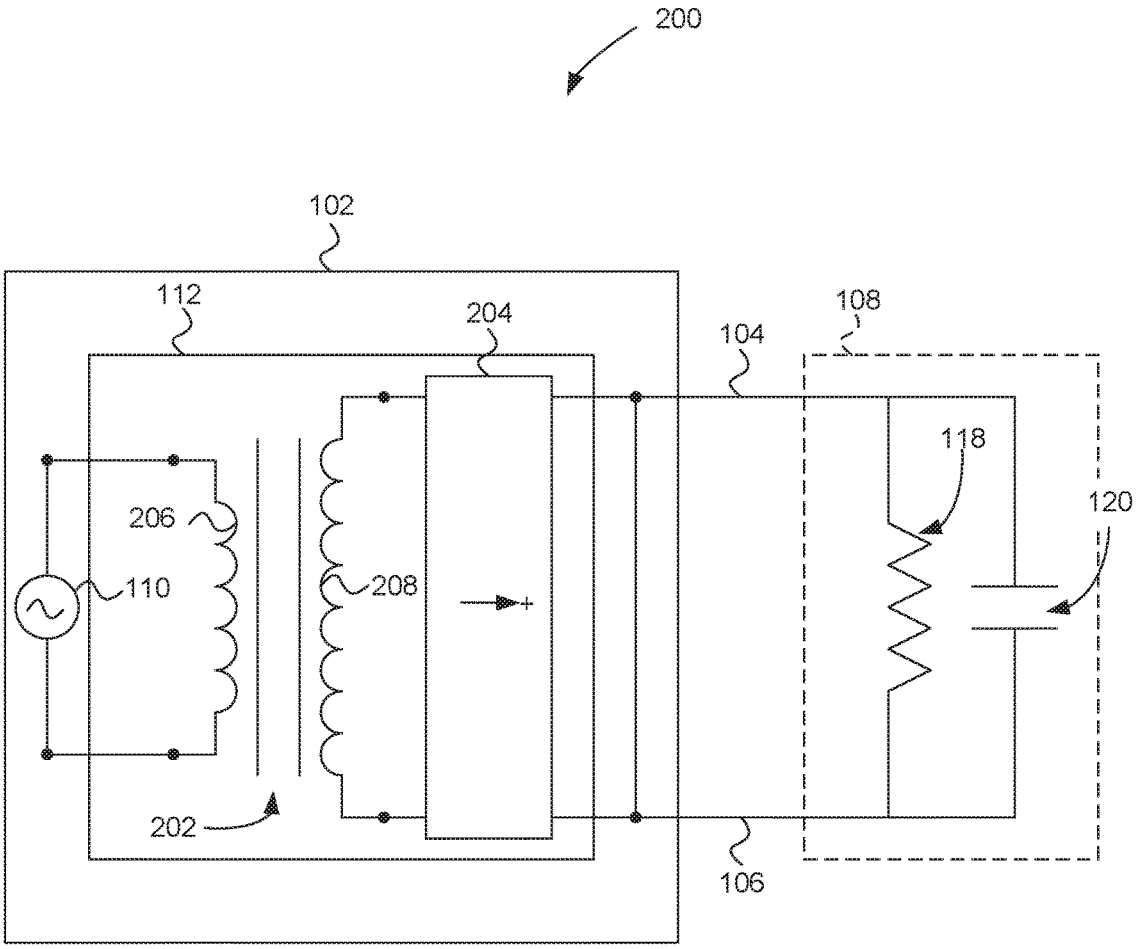
FIG. 2 is a circuit diagram of a power supply for applying voltage to a combustion flame, according to an embodiment.

FIG. 2 illustrates an electrodynamic flame control system 200 that shows a particular implementation of the AC/DC voltage converter 112, according to one embodiment. The AC/DC voltage converter 112 can include a transformer 202 electrically coupled or connected to a rectifier 204. The transformer 202 can be a step-up transformer having a primary winding 206 and a secondary winding 208. The secondary winding 208 can have more windings than the primary winding 206. The ratio between the turns of the secondary winding 208 and the turns of the primary winding 206 can be, for example, 100:1, 200:1, 400:1, or another value, according to various embodiments.

The rectifier 204 is electrically coupled to the secondary winding 208 of the transformer 202, according to one embodiment. The rectifier 204 can be a half-wave or a full-wave bridge rectifier, according to various embodiments.

The electrodynamic flame control system 200 excludes or omits an output capacitance between the rectifier 204 and the combustion flame 108, according to one embodiment. By excluding an output capacitance or low pass output filter, the power supply 102 can rapidly charge the capacitance 120 of the combustion flame 108 without storing electrical charge at the output of the power supply 102, e.g., at the electrodes 104 and 106.

Figure 3:
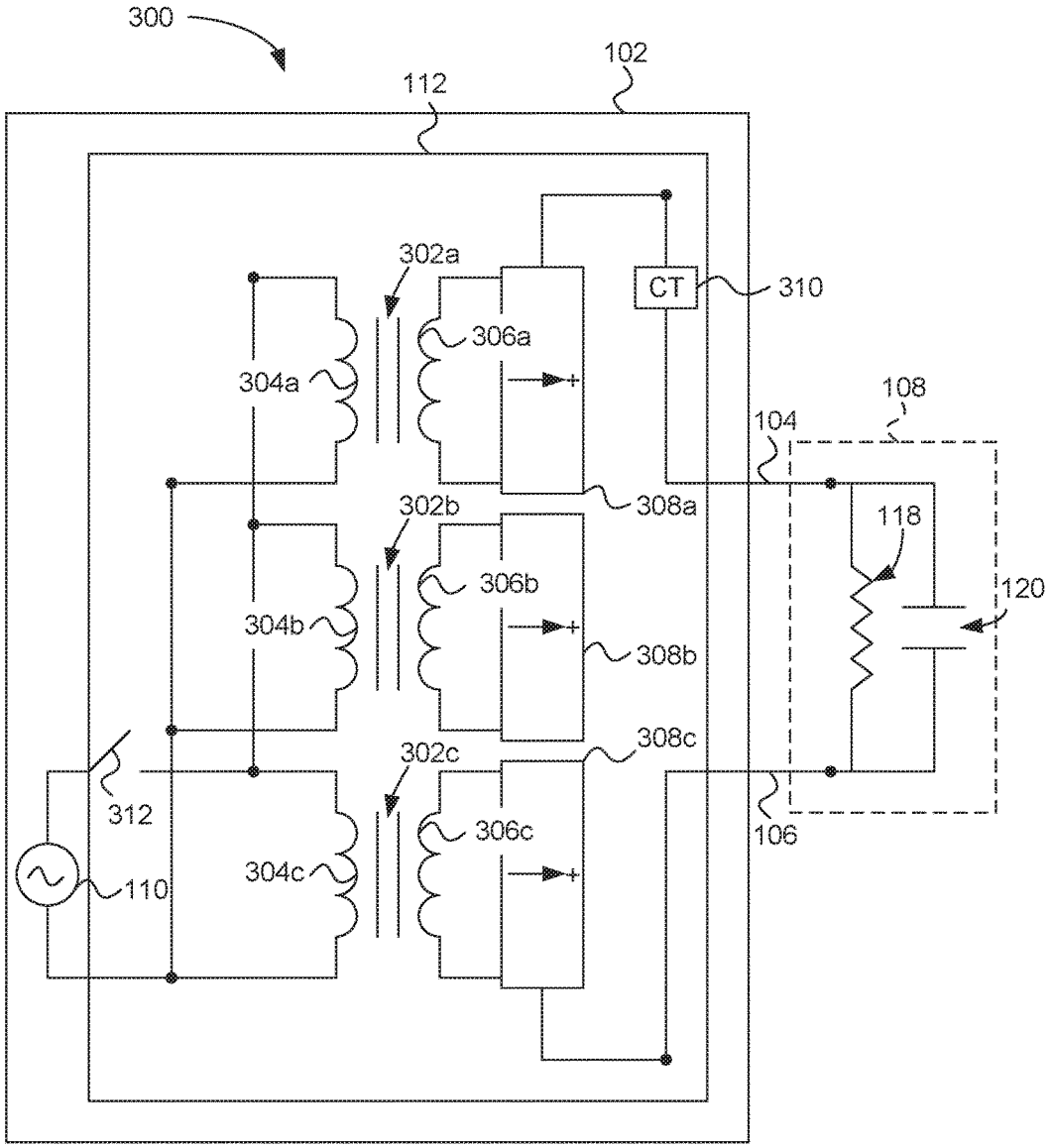
FIG. 3 is a circuit diagram of a power supply for applying voltage to a combustion flame, according to an embodiment.

FIG. 3 illustrates an electrodynamic flame control system 300 that shows another implementation of the AC/DC voltage converter 112, according to another embodiment. The AC/DC voltage converter 112 can include one or more transformers 302*a*, 302*b*, and 302*c* (collectively transformers 302) electrically coupled or connected in parallel. The transformers 302 include primary windings 304 (inclusive of 304*a*, 304*b*, 304*c*) and secondary windings 306 (inclusive of 306*a*, 306*b*, 306*c*). In one embodiment, the primary windings 304 of the transformers 302 are electrically coupled or connected in parallel, and the secondary windings 306 are each electrically coupled or connected to rectifiers 308*a*, 308*b*, and 308*c* (collectively rectifiers 308), respectively, according to one embodiment. The rectifiers 308 can be electrically coupled or connected in series so that the total or cumulative output of the AC/DC voltage converter 112 is approximately the sum of the voltage across each of the rectifiers 308. The rectifier 308*a* may be coupled to the electrode 104 and the rectifier 308*c* may be coupled to the electrode 106. Although three transformers 302 and three rectifiers 308 are illustrated, in other embodiments, more than three or fewer than three of the transformers 302 and the rectifiers 308 may be employed.

An advantage of the configuration of the electrodynamic flame control system 300 is that the parasitic capacitances of each of the transformers 302 may be charged during operation and may not be subject to periodic discharge, that is at least partially based on the configuration of the rectifiers 308 and connections between them.

In one embodiment, the AC/DC voltage converter 112 includes a current detection circuit 310 coupled between the rectifiers 308 and the combustion flame 108. Different methods for current detection may be used to control normal current flowing in the system, e.g., by detecting the rate of current increase. When normal current (or a current increase rate) exceeds a predetermined level, the detection circuit 310 may be configured to open one or more switching circuits 312 to discontinue charging the combustion flame 108. The current detection circuit 310 may use a plurality of current detectors that include, but are not limited to, resistive shunts, current transformers, Hall sensors and Rogowsky coils, among others. Current flowing in the system may be detected and switched off to prevent shock hazards or damage to combustion equipment.

Figure 4:
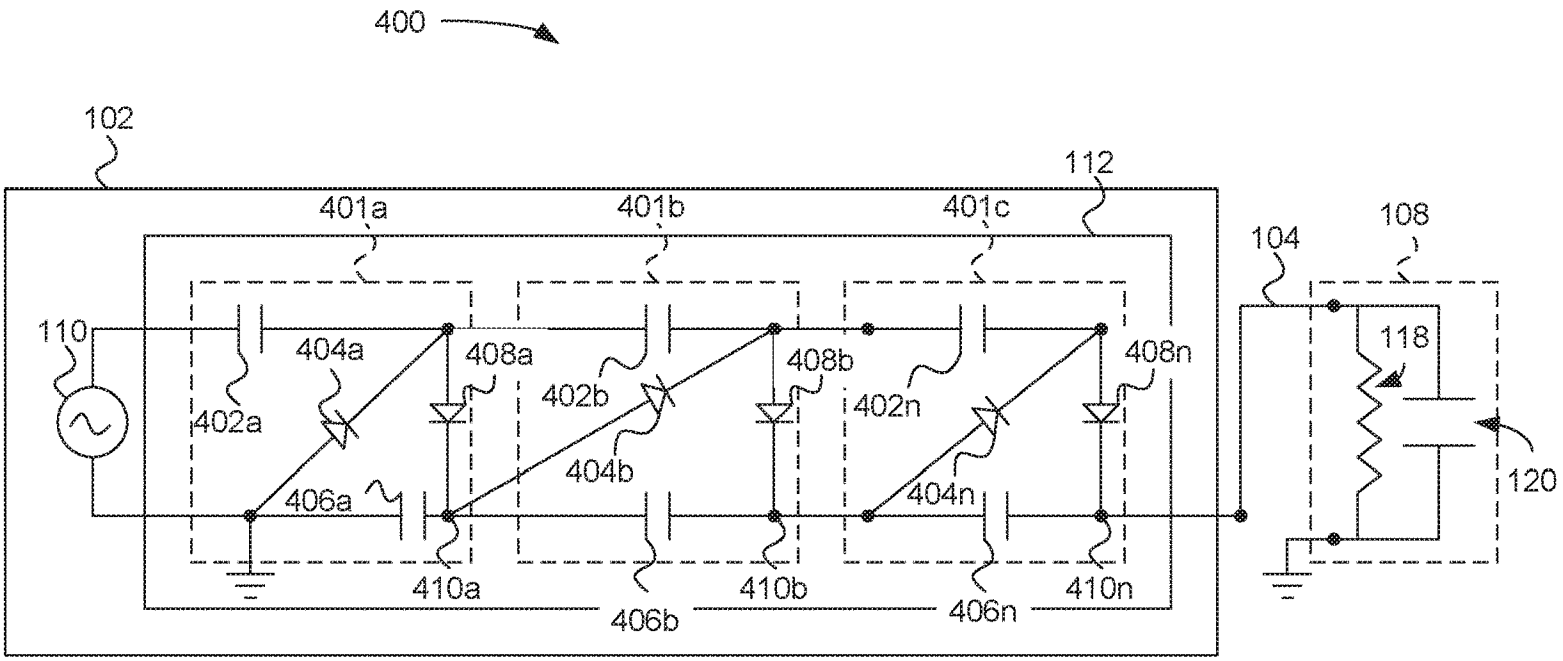
FIG. 4 is a circuit diagram of a power supply for applying voltage to a combustion flame, according to an embodiment.

FIG. 4 illustrates an electrodynamic flame control system 400 that shows a particular implementation of the AC/DC voltage converter 112, according to one embodiment. The AC/DC voltage converter 112 can be configured as a voltage multiplier and can include several voltage multiplier stages of switches (e.g., diodes) and capacitors. In one embodiment, the AC/DC voltage converter 112 can be a Villard cascade voltage multiplier, which multiplies the AC voltage signal from the AC power supply 110 and converts the AC voltage signal to a DC voltage signal. The AC/DC voltage converter 112 of the electrodynamic flame control system 400 can include a first voltage multiplier stage 401*a*, a second voltage multiplier stage 401*b*, and an nth voltage multiplier stage 401*n* (collectively, voltage multiplier stages 401), according to one embodiment. The voltage multiplier stages 401 can each include a capacitor 402 (inclusive of capacitors 402*a*, 402*b*, and 402*n*), a diode 404 (inclusive of diodes 404*a*, 404*b*, and 404*n*), a capacitor 406 (inclusive of capacitors 406*a*, 406*b*, and 406*n*), and a diode 408 (inclusive of diodes 408*a*, 408*b*, and 408*n*). Each voltage multiplier stage 401 can include an output node 410*a*, 410*b*, and 410*n* (collectively, output nodes 410). By implementing low-capacitance components, the voltage multiplier configuration of the AC/DC voltage converter 112 can maintain an output capacitance for the power supply 102 that is less than or equal to the capacitance 120, i.e., the load capacitance. The higher the output frequency of the power supply 102, e.g., an inverter, the smaller the capacitors 402 and 406 can be while providing adequate function.

The various configurations of the AC/DC voltage converter 112 or of the power supply 102 enable inertialess, e.g., low capacitance, voltage generation that enables rapid charging and discharging of the combustion flame 108, according to the various disclosed embodiments.

Figure 5:
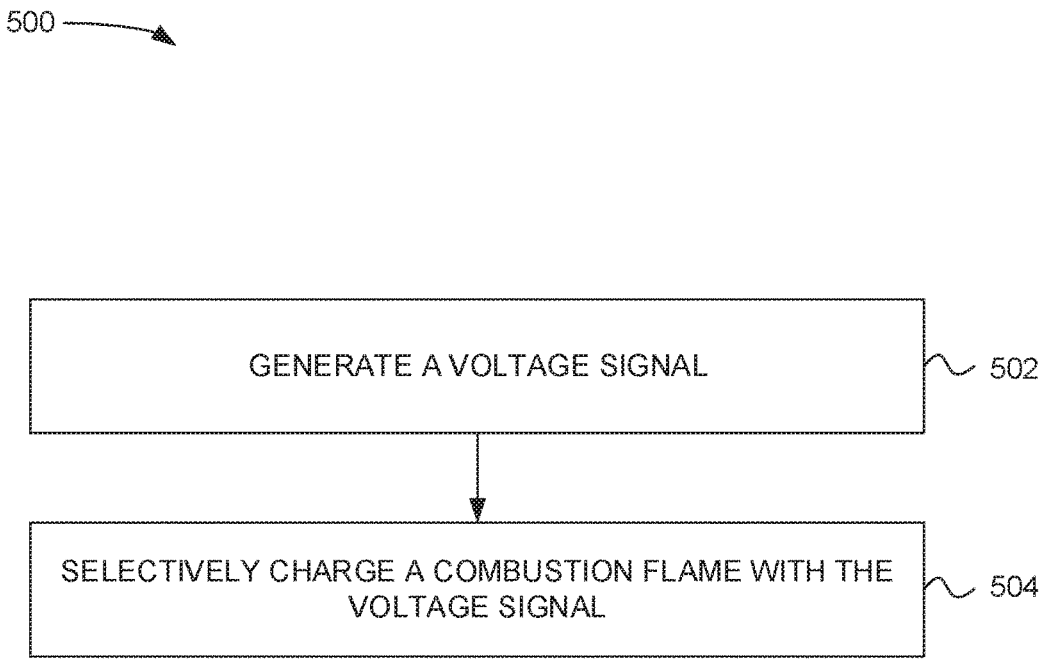
FIG. 5 is a flow diagram of a method for electrically controlling a combustion flame, according to an embodiment.

FIG. 5 illustrates a method 500 for electrically controlling a combustion flame, according to one embodiment.

At step 502, a power supply generates a voltage signal. The voltage signal can be a positive polarity DC voltage signal and not a negative polarity DC voltage signal. Alternatively, the voltage signal can be a negative polarity DC voltage signal and not a positive polarity DC voltage signal.

At step 504, the power supply selectively charges a combustion flame with the voltage signal. The power supply is coupled to the combustion flame with an electrode to alter one or more characteristics of the combustion flame. The combustion flame can be generated with a burner. The combustion flame includes a resistance and a load capacitance. The electrode can be positioned proximate to and within the combustion flame, according to one embodiment. The output capacitance of the power supply can be less than or equal to the load capacitance to enable rapid discharge of the combustion flame.

Figure 6:
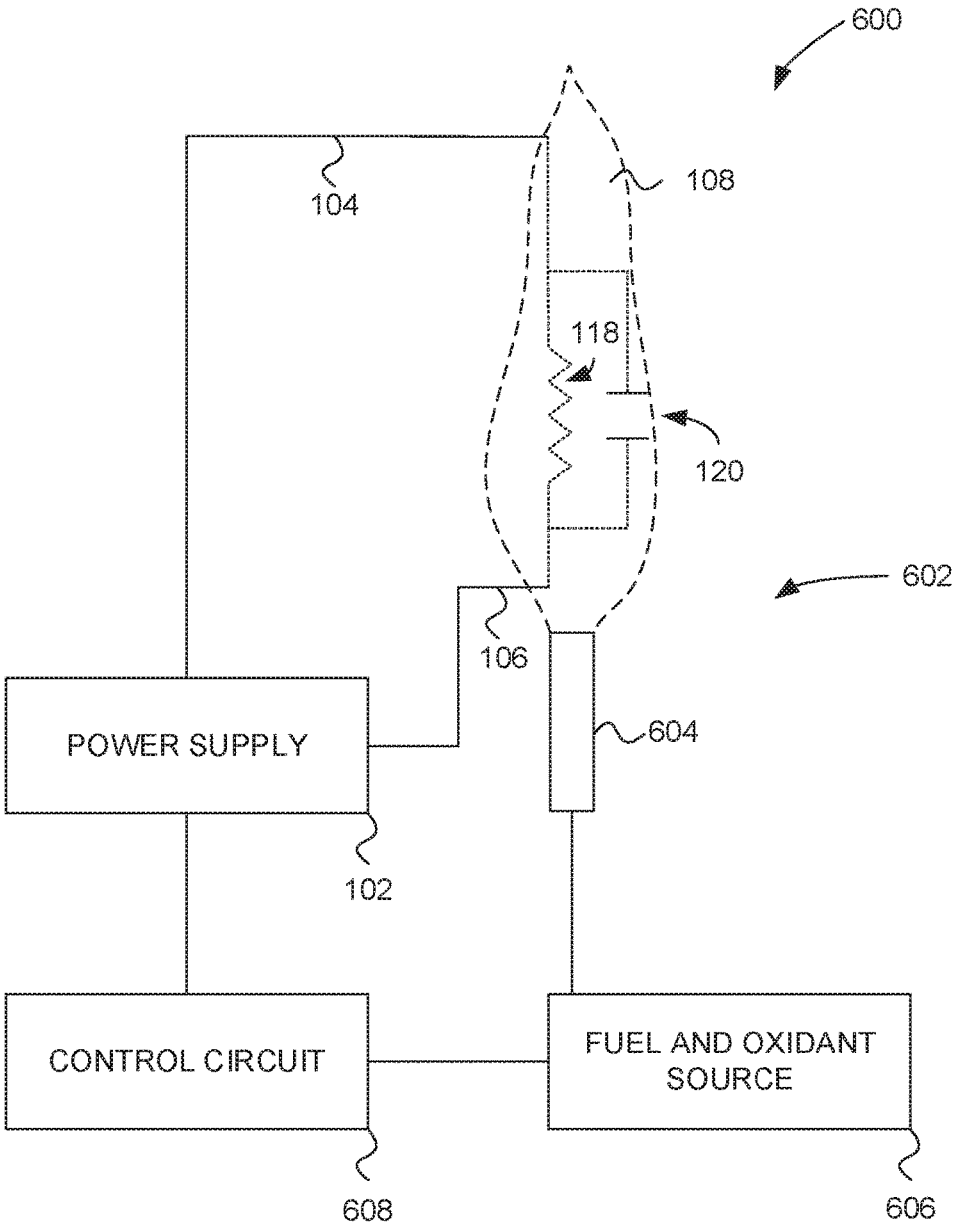
FIG. 6 is a diagram of a combustion system including the power supply of FIGS. 1-4, according to an embodiment.

FIG. 6 is a block diagram of a combustion system 600, according to an embodiment. The combustion system 600 includes a burner 602 and a power supply 102. The burner 602 includes a fuel nozzle 604 and a fuel and oxidant source 606. The combustion system 600 further includes electrodes 104, 106.

According to an embodiment, the fuel and oxidant source 606 can supply fuel and oxidant to the fuel nozzle 604. The fuel nozzle 604 outputs the fuel and oxidant into the combustion volume to support a combustion flame 108. The burner 602 can be configured to hold the combustion flame 108 at the fuel nozzle 604 or at a position separated from the fuel nozzle 604. Although a single fuel nozzle 604 that outputs both fuel and oxidant is shown in FIG. 6, the burner 602 can include multiple nozzles. The multiple nozzles can include one or more nozzles dedicated to outputting only fuel, one or more nozzles dedicated to output only oxidant, or nozzles that output a mixture of fuel and oxidant. Alternatively, the combustion system 600 can include any other suitable configuration for outputting fuel and oxidant to support a combustion flame 108.

According to an embodiment, the power supply 102 is a power supply as described with reference to FIGS. 1-5 having a low output capacitance. According to an embodiment, the power supply 102 has an output capacitance that is less than the capacitance of the combustion flame 108.

According to an embodiment, the power supply 102 applies a voltage across the combustion flame 108 by applying a voltage between the electrodes 104, 106. The electrodes 104, 106 are shown as being in contact with the combustion flame 108. However, the electrodes 104, 106 can be positioned in any suitable configuration for applying a charge, a voltage, an electrical potential, or an electric field to the combustion flame 108. For example, the electrode 104 can be positioned in a stream of fuel and oxidant as it exits the fuel nozzle 604 prior to arriving at the combustion flame 108, while the electrode 106 can be positioned at an end of the combustion flame 108.

As illustrated in FIG. 6, the combustion flame 108 has both a resistance 118 and a capacitance 120. As described previously, the resistance 118 of the combustion flame 108 can be about 5-15 MΩ. The capacitance 120 of the combustion flame 108 can be about 3-5 pF. According to an embodiment, because the output capacitance of the power supply 102 is very low, the power supply 102 can be configured to rapidly charge the capacitance 120 of the combustion flame 108, according to one embodiment. Additionally, by having an output capacitance that is less than the load capacitance, e.g., 3-5 pF, the power supply 102 or another power supply can be coupled to the combustion flame 108 to charge the capacitance 120 to another voltage polarity, e.g., to a negative DC voltage, without having to first discharge the output capacitance or low pass output filtering of the power supply 102. For example, if the power supply 102 is configured to supply 100 mA, the power supply 102 could charge a 5 pF capacitance of the combustion flame 108 from 0 V to 40 kV in approximately 2 μs. Assuming a similar discharge time for the capacitance 120, the power supply 102 can be configured to alternate between selectively charging and discharging the combustion flame 108 at a frequency of approximately 500 kHz, according to one embodiment.

According to an embodiment, the combustion system 600 includes a control circuit 608 coupled to the power supply 102. The control circuit 608 includes a non-transitory computer-readable medium having instructions and a processor configured to read the computer-readable medium and to execute the instructions to perform a method for electrically controlling a combustion flame. The method includes generating a voltage signal with the power supply 102. The voltage signal includes a positive polarity and not a negative polarity. The method further includes selectively charging the combustion flame 108 with the voltage signal by coupling the power supply 102 to the combustion flame 108 with the electrode 104,106 to alter one or more characteristics of the combustion flame 108.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A system for electrically controlling a combustion flame, comprising:

a burner configured to generate the combustion flame having a resistance and a first capacitance;

at least one electrode positioned proximate to the burner to couple the at least one electrode to the combustion flame; and a power supply coupled to the at least one electrode and configured to provide a voltage signal to the combustion flame and charge the first capacitance, the power supply having a second capacitance that is less than the first capacitance.

2. The system of claim 1, wherein the first capacitance is between 3-5 picofarads.

3. The system of claim 1, wherein the second capacitance is less than 5 picofarads.

4. The system of claim 1, wherein the power supply includes:

a rectifier; and a step-up transformer electrically coupled to the rectifier, the step-up transformer having:

a primary winding; and a secondary winding electrically coupled to the rectifier and having more turns than the primary winding.

5. The system of claim 4, wherein the rectifier is a half-wave rectifier.

6. The system of claim 4, wherein the rectifier is a full-wave bridge rectifier.

7. The system of claim 1, wherein the power supply is configured to operate between approximately 75 kHz and 125 kHz.

8. The system of claim 1, wherein the power supply includes:

a number of transformers connected to each other in parallel;

a number of rectifiers electrically connected in series and each connected to a respective one of the transformers.

9. The system of claim 8, wherein each of the number of rectifiers is a full-wave bridge rectifier.

10. The system of claim 1, wherein the power supply is a voltage multiplier, wherein the voltage signal supplied by the voltage multiplier includes a single-polarity.

11. The system of claim 1, wherein the voltage signal is at least 4 kV.

12. The system of claim 1, wherein the voltage signal is approximately between 30 kV and 50 kV.

13. The system of claim 1, wherein the at least one electrode includes a cathode and an anode, and the cathode is within a visible spectrum of the combustion flame to charge the first capacitance with the voltage signal.

14. A method for electrically controlling a combustion flame, comprising:

generating a voltage signal with a power supply having an output capacitance, wherein the voltage signal includes a positive polarity and not a negative polarity; and altering one or more characteristics of the combustion flame by selectively charging the combustion flame with the voltage signal by coupling the power supply to the combustion flame with an electrode, wherein the combustion flame is generated with a burner, wherein the combustion flame includes a resistance and a load capacitance, wherein the electrode is positioned proximate to and within the combustion flame, wherein the output capacitance is less than or equal to the load capacitance to enable rapid discharge of the power supply.

15. The method of claim 14, wherein the load capacitance is between 3-5 picofarads.

16. The method of claim 14, wherein the output capacitance is less than 5 picofarads.

17. The method of claim 14, wherein the power supply includes a transformer electrically coupled to a rectifier, wherein the transformer is a step-up transformer having a primary winding and a secondary winding, the primary winding having fewer turns than the secondary winding, wherein the secondary winding of the transformer is electrically coupled to the rectifier, wherein the rectifier is electrically coupled to the electrode.

18. The method of claim 17, wherein the rectifier is a half-wave rectifier.

19. The method of claim 17, wherein the rectifier is a full-wave bridge rectifier.

20. The method of claim 14, wherein the power supply is configured to operate between approximately 75 kHz and 125 kHz.

21. The method of claim 14, wherein the power supply includes a number of transformers electrically coupled to a number of rectifiers, wherein each of the transformers includes a primary winding, wherein each of the primary windings of each of the number of transformers is electrically connected in parallel to each primary winding of each of the other ones of the number of transformers, wherein the number of rectifiers are electrically connected in series, wherein one of the number of rectifiers is electrically connected to the electrode.

22. The method of claim 21, wherein each of the number of rectifiers is a full-wave bridge rectifier.

23. The method of claim 14, wherein the power supply includes a voltage multiplier, wherein the voltage signal supplied by the voltage multiplier includes a single-polarity.

24. The method of claim 14, wherein the voltage signal includes a peak that is at least 4 kV.

25. The method of claim 14, wherein the voltage signal includes at least 4 kV root mean squared.

26. The method of claim 14, wherein the voltage signal is approximately between 30 kV and 50 kV.

27. The method of claim 26, wherein the voltage signal is approximately between 30 kV and 50 kV root mean squared.

28. The method of claim 14, wherein the electrode is a cathode electrode.

29. The method of claim 14, further comprising:

generating a negative voltage signal with the power supply, wherein the negative voltage signal includes a negative polarity and not a positive polarity; and selectively charging the combustion flame with the negative voltage signal by coupling the power supply to the combustion flame with a second electrode to alter one or more characteristics of the combustion flame, wherein the second electrode is positioned proximate to and within the combustion flame.

30. A computer-implemented system for electrically controlling a combustion flame, the system comprising:

a non-transitory computer-readable medium having instructions; and a processor configured to read the computer-readable medium and to execute the instructions to perform a method for electrically controlling a combustion flame, the method comprising:

generating a voltage signal with a power supply having an output capacitance, wherein the voltage signal includes a positive polarity and not a negative polarity; and selectively charging the combustion flame with the voltage signal by coupling the power supply to the combustion flame with an electrode to alter one or more characteristics of the combustion flame, wherein the combustion flame is generated with a burner, wherein the combustion flame includes a resistance and a load capacitance, wherein the electrode is positioned proximate to and within the combustion flame, wherein the output capacitance is less than or equal to the load capacitance to enable rapid discharge of the power supply.

31. The system of claim 30, wherein the load capacitance is between 3-5 picofarads.

32. The system of claim 30, wherein the output capacitance is less than 5 picofarads.

33. The system of claim 30, wherein the power supply includes a transformer electrically coupled to a rectifier, wherein the transformer is a step-up transformer having a primary winding and a secondary winding, the primary winding having fewer turns than the secondary winding, wherein the secondary winding of the transformer is electrically coupled to the rectifier, wherein the rectifier is electrically coupled to the electrode.

34. The system of claim 33, wherein the rectifier is a full-wave bridge rectifier.

35. The system of claim 30, wherein the power supply is configured to operate between approximately 75 kHz and 125 kHz.

36. The system of claim 30, wherein the power supply includes a number of transformers electrically coupled to a number of rectifiers, wherein each of the number of transformers is electrically connected in parallel to each of the other ones of the number of transformers, wherein the number of rectifiers are electrically connected in series, wherein one of the number of rectifiers is electrically connected to the electrode.

37. The system of claim 36, wherein each of the number of rectifiers is a full-wave bridge rectifier.

38. The system of claim 30, wherein the power supply includes a voltage multiplier, wherein the voltage signal supplied by the voltage multiplier includes a single-polarity.

39. The system of claim 30, wherein the voltage signal is at least 4 kV root mean squared.

40. The system of claim 30, wherein the voltage signal is at least 30 kV root mean squared.

* * * * *